US005201127A

United States Patent [19]

Whitaker, Jr.

[11] Patent Number: 5,201,127

[45] Date of Patent: Apr. 13, 1993

[54] SELF METERING BALLAST SYSTEM

[75] Inventor: John B. Whitaker, Jr., Wetumpka, Ala.

[73] Assignee: Keshaw Manufacturing Company, Inc., Wetumpka, Ala.

[21] Appl. No.: 836,875

[22] Filed: Feb. 19, 1992

[51] Int. Cl.[5] ..... E02F 5/22; E01B 27/17

[52] U.S. Cl. ..... 37/107; 37/104; 104/2; 104/7.3

[58] Field of Search ..... 37/104, 107; 104/2, 104/7.3; 171/16

[56] References Cited

U.S. PATENT DOCUMENTS

| | | | |
|---|---|---|---|
| 4,108,076 | 8/1978 | Knape | 104/2 |
| 4,479,439 | 10/1984 | Theurer et al. | 104/2 X |
| 4,760,796 | 8/1988 | Theurer et al. | 104/7.3 |
| 4,794,862 | 1/1989 | Theurer | 37/104 X |
| 4,835,887 | 6/1989 | Theurer | 37/104 |
| 4,967,847 | 11/1990 | Whitaker, Jr. | 37/107 X |
| 5,090,484 | 2/1992 | Theurer et al. | 37/104 X |

*Primary Examiner*—Dennis L. Taylor
*Assistant Examiner*—J. Russell McBee
*Attorney, Agent, or Firm*—Veal & Associates

[57] ABSTRACT

A ballast metering method and apparatus is disclosed which utilizes a rail mounted metering hopper having a set of forward discharge outlets for directing ballast laterally and downwardly beneath the rails under the pressure of a volume of ballast retained in the hopper. This volume is maintained at a continuously maintained level by selective addition of ballast to the hopper. The discharged ballast forms a pair of spaced apart windrows beneath the rails which is graded to a predetermined height by a sub-track grader blade associated with the hopper. A center discharge opening at the rear of the hopper allows ballast to be directed between the graded windrows. A pair of lateral chutes permit discharge of ballast outwardly of the rails.

21 Claims, 4 Drawing Sheets

SELF METERING BALLAST SYSTEM

FIELD OF THE INVENTION

The present invention relates to railroad track maintenance and in particular to replacing the ballast beneath the ties and rails of a railroad. In even greater particularity, the present invention relates to apparatus for automatically metering the amount of ballast replaced beneath the track.

BACKGROUND OF THE INVENTION

In modern track maintenance machinery the return of ballast to beneath the track must be accomplished in a uniform manner; however, most known devices leave something to be desired in their state of automation. Specifically, a problem exists in getting the proper amount of ballast beneath the ties and in preventing unwanted accumulation of ballast when the machinery is stopped, as occasionally happens.

It is the object of the present invention to provide a self metering ballast dispersal apparatus for use in a high output ballast cleaning system.

The further object of the present invention is to accurately deposit ballast beneath an existing rail system.

Yet another object of the invention is to prevent excessive accumulation of ballast along the track.

These and other objects and features of my invention are accomplished through the use of a combination of elements that distribute and level a quantity of ballast beneath a track which has been undercut to remove fouled ballast therebeneath. The ballast is automatically metered though a hopper which directs the ballast to beneath the rails and along the center of the track, the hopper being specifically designed to automatically prevent excessive accumulation of ballast along the track when the machinery has stopped. The hopper is equipped with sensor devices to detect the level of ballast therein and with a conveyor to electively move ballast for discharge through a forward or rear discharge opening.

BRIEF DESCRIPTION OF THE DRAWINGS

Apparatus embodying features of my invention are depicted in the accompanying drawings which form a portion of this disclosure and wherein.

DESCRIPTION OF A PREFERRED EMBODIMENT

Figure 1:
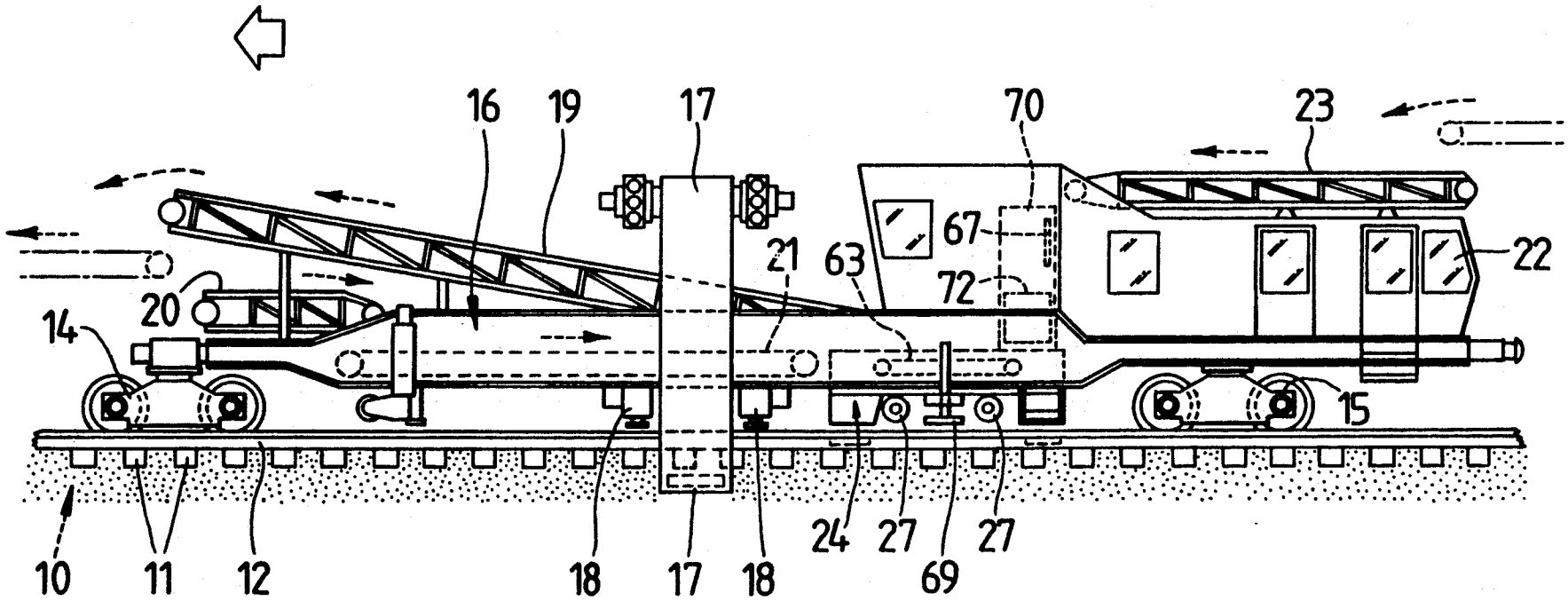
FIG. 1 is a side elevational view of a ballast cleaning apparatus in which my device is used.

It is helpful to the understanding of the claimed invention to understand the intended environment of use; thus, in FIG. 1 it may be seen that my invention may be used as a part of a ballast cleaning system. In FIG. 1, a railroad track is shown including a ballast bed 10 supporting a plurality of crossties 11 and a pair of parallel rails 12. Supported on the rails is a track maintenance car 13 having a front and rear bogie 14 and 15 and an intermediate main frame 16 extending therebetween. The main frame 16 supports a track undercutter 17 of conventional design and an associated track lifting apparatus 18 which engages the rails 12 and supports the rails and crossties 11 when the undercutter 17 removes ballast from beneath the same. Associated with the undercutter 17 is a conveyor 19 which carries the removed ballast from the car 13 to a conventional screening device (not shown) which cleans the ballast and reclaims a portion thereof for reuse. The reclaimed portion is returned to the car 13 on conveyor 20 and passed rearwardly of the undercutter 17 on conveyor 21.

Figure 2:
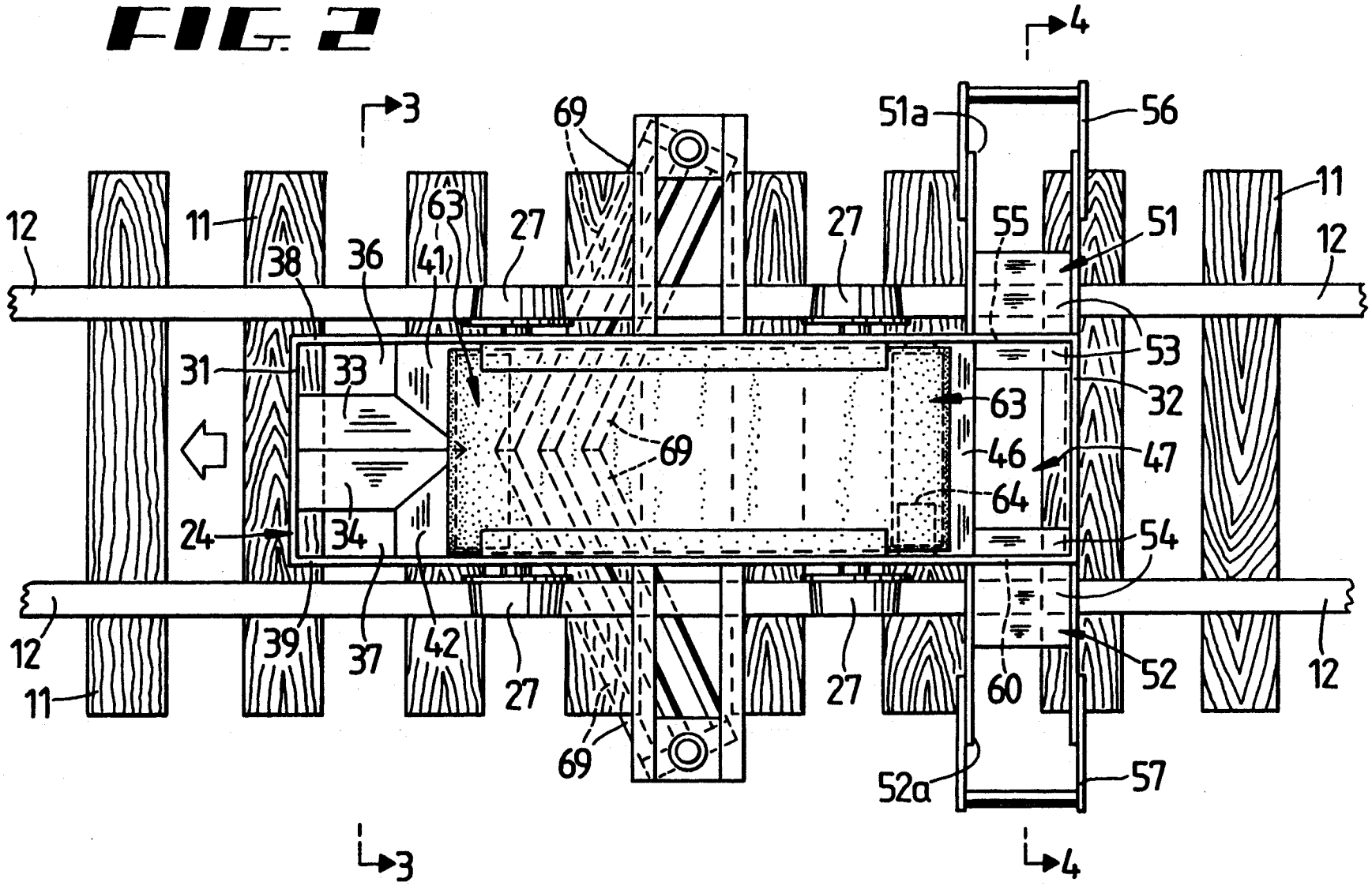
FIG. 2 is a plan view of the hopper of my device.
Figure 3:
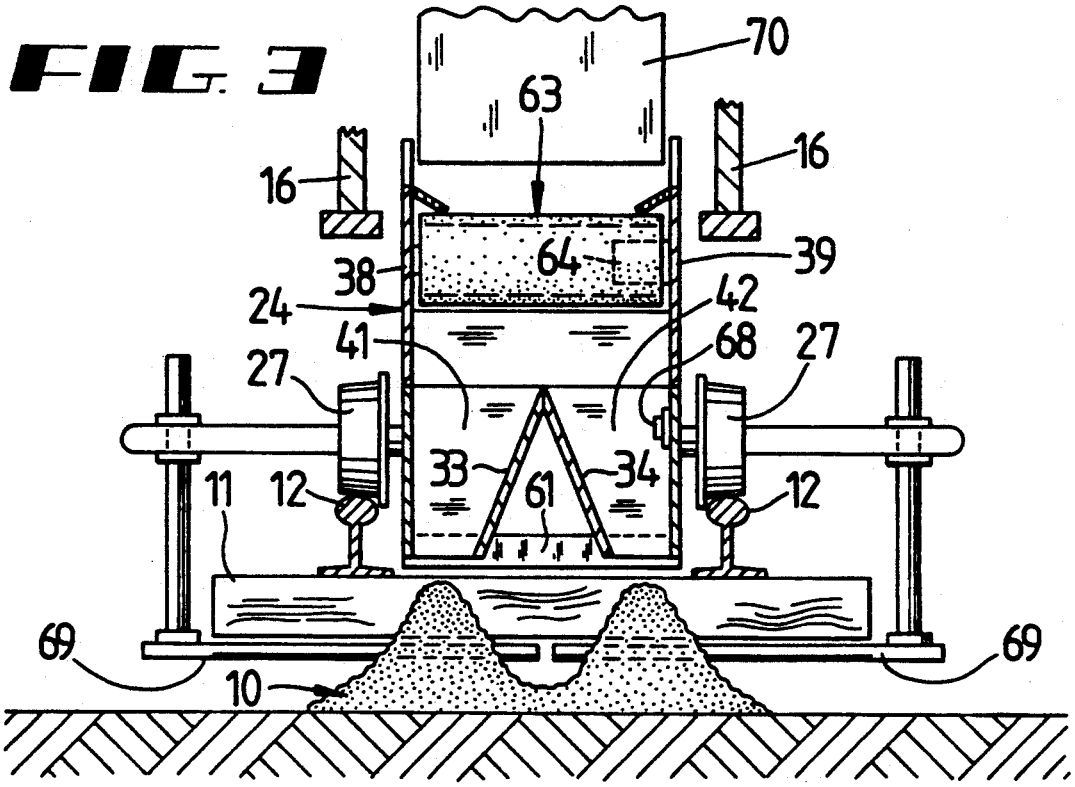
FIG. 3 is a sectional view of the device taken along line 3—3 of FIG. 2.
Figure 4:
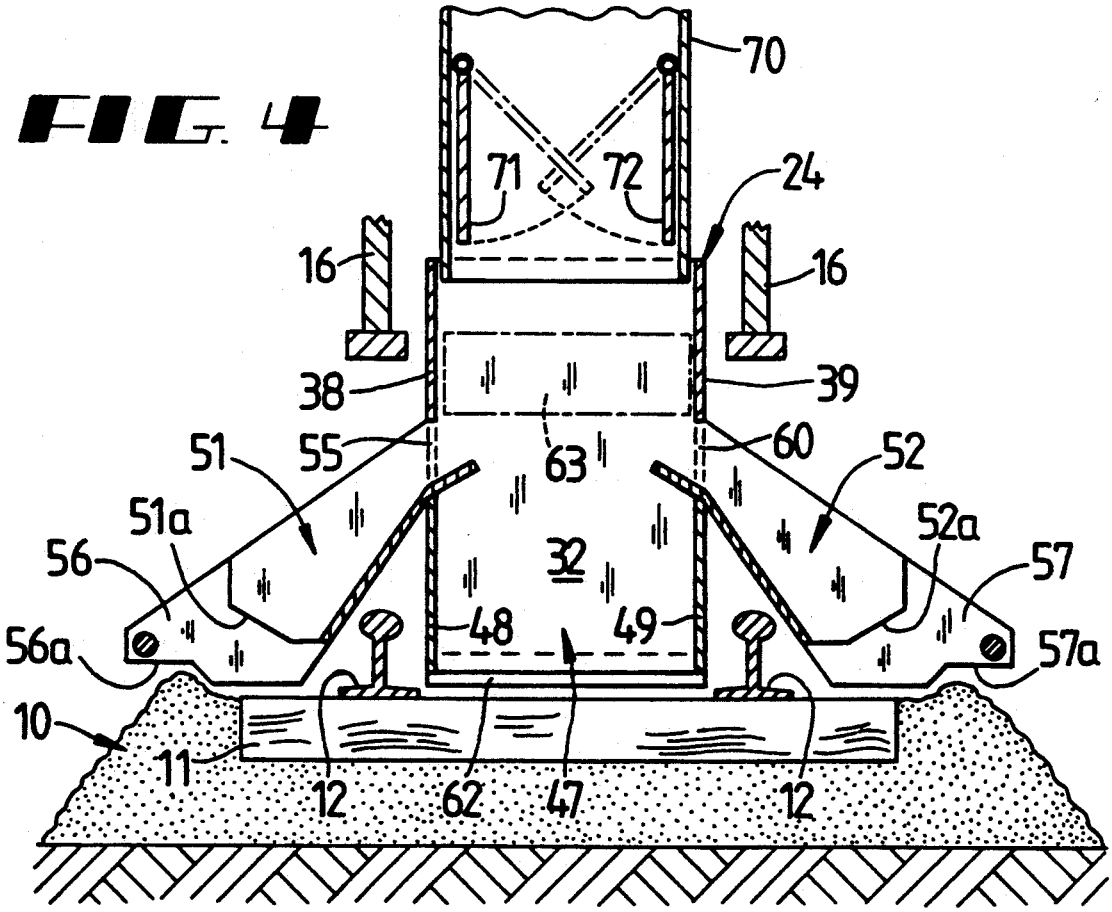
FIG. 4 is a sectional view of the device taken along line 4—4 of FIG. 2.
Figure 5:
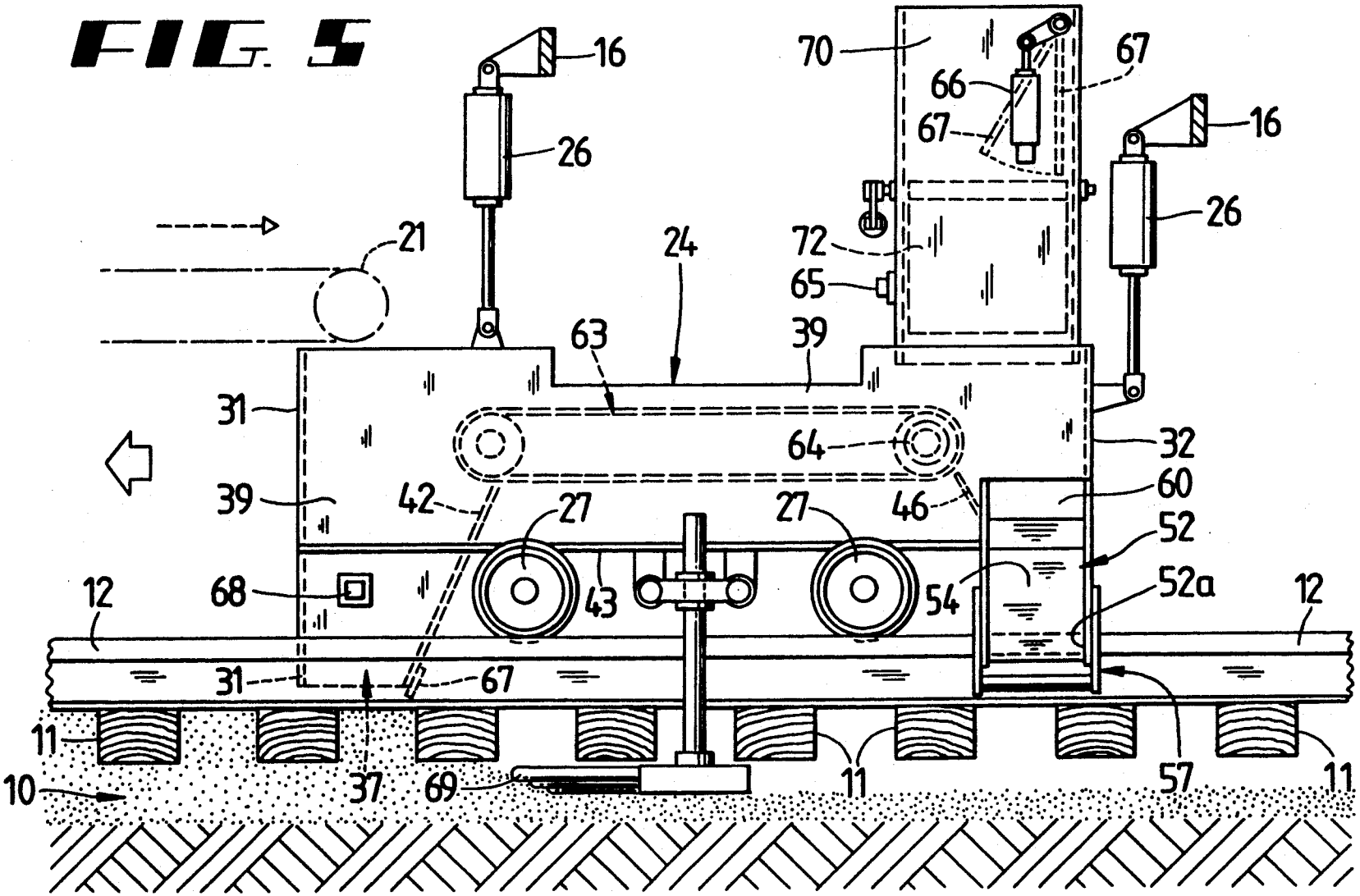
FIG. 5 is a side elevation view of the device.

Also supported on frame 16 may be a cab and operator station module 22. Their presence is not required; however, in the car 13 shown in FIG. 1, the module supports a conveyor 23 which delivers new or fresh ballast from a supply car (not shown). As can be seen in FIG. 1, conveyor 21 and 23 both deliver ballast to the area immediately behind the undercutter 17. It is in this area that my invention is employed. With reference to FIG. 1 and 2 note that I use a hopper 24 which is supported by frame 16 and movable vertically relative therein by a set of hydraulic actuators 26. When the hopper 24 is at its lowermost position, however, it is supported directly on rails 12 by a set of rail rollers 27. Thus as car 13 moves along the rails 12, the hopper 24 also moves along the rails 12.

The hopper 24 includes a forward wall 31 and a rear wall 32. Forward wall 31 is affixed to a pair of downwardly diverging bottom deflector plates 33 and 34 which divides the forward portion of the hopper into two funnel-like members which direct ballast downwardly and outwardly through a pair of forward discharge openings 36 and 37 found at the bottom of forward wall 31, bottom plates 33 and 34, side walls 38 and 39 and a pair of extension walls 41 and 42. The extension walls 41 and 42 extend generally perpendicular to the sidewalls and bottom portion and connect to a bottom 43 and bottom deflector plates 33 and 34 respectively which runs longitudinally rearwardly therefrom. Bottom 43 is affixed to side walls 38 and 39 and to a rear chute wall 46 which along with rear wall 32 partially define a center discharge opening 47 intermediate the rails. A pair of lower extensions 49 and 49 define the side walls of center discharge opening beneath side walls 38 and 39.

A pair of lateral chutes 51 and 52 extend outwardly and downwardly from a pair of opposed side discharge openings 55 and 60 in side walls 38 and 39 above center discharge opening 47. Chutes 51 and 52 each have a deflection plate 53 and 54 respectively extending within side walls 38 and 39 and extend outwardly beyond rails 12. Each chute has a movable skirt 56 and 57 attached to its lower end 51*a* and 52*a* with each skirt defining an outer second profile 56*a* and 57*a*.

A grader blade 61 is mounted rearwardly of the forward discharge openings 36 and 37 such that when the hopper rests on the rail rollers 27, the grader blade 61 is supported at a height of about one inch above the crosstie to effectively remove any ballast deposited thereon from the forward discharge openings 36 and 37. Likewise, a grader blade 62 trails the center discharge opening 47 to remove any ballast deposited along the crossties through this opening.

Mounted within the hopper 24 for driven movement is a conveyor 63 which extends longitudinally between the medium side walls 38 and 39 and may be a belt conveyor mounted on a set of rollers and driven in a conventional manner by a hydraulic motor 64. During normal operation, ballast which has been removed by the undercutter 17, cleaned and returned by the conveyor 21 is deposited in the forward portion of the hopper 24. The quantity of ballast deposited therein should be sufficient to maintain a level of ballast in the hopper sufficient to maintain adequate downward force on the ballast exiting through the forward discharge openings to cause the ballast to windrow substantially adjacent and partially beneath the rails 12. That is to say, the ballast within the hopper is somewhat fluid, flowing downwardly through the discharge openings; thus, by maintaining a level of ballast within the hopper a gravitational head or pressure is exerted by the overlying mass on the lowermost ballast to urge it out of the hopper into windrows. If this level is not maintained, then less pressure is exerted on the discharged ballast and inconsistent windrowing may occur. Thus, located at a level within the hopper 24 at a selected height is a proximity sensor 65 which detects the presence of ballast at the selected height. If inadequate ballast is present, then sensor 65 activates the hydraulic motor 64 which drives the conveyor 63 and actuates a cylinder 66 which extends a deflector 67 mounted to the rear wall of a rear feed chute 70. Thus, ballast delivered to the rear of the hopper 24 by conveyor 23 is deflected onto conveyor 63 and transported forwardly to make up the deficiency in the ballast in the forward part of the hopper. Likewise, a secondary sensor 68 can be mounted in the forward part of the hopper to sense the presence of excess cleaned ballast and actuate motor 64 to drive conveyor 63 rearwardly.

Mounted to the frame 16 beneath the hopper and rearwardly of the forward opening is a grader bar 69 which extends transversely beneath the track such that the windrow of ballast is graded to a level surface at a selected height. For example, the height of the ballast may be graded such that the track can go back to a level surface two inches higher than it was before the undercutter removed the old ballast. New ballast or reconditioned ballast is introduced through the center discharge opening 47 intermediate the graded windrows and serves to further stabilize the ballast as the track is placed thereon. Conveyor 23 must deliver sufficient ballast to the rear of hopper 24 to maintain the level of ballast above the side discharge openings 55 and 60 so that ballast is distributed by chutes 51 and 52 outwardly of the rails to yield 100% replenishment of the ballast beneath the track.

It will further be appreciated that when the undercutter stops, such as at a road crossing or the like and the vehicle is halted, ballast being delivered into the hopper will be retained in the hopper and the ballast discharged from the openings will back up to the opening and prevent further discharge of ballast onto the track from conveyors 21 and 23. Sensing means may be incorporated into the hopper to stop these conveyors if the hopper were to become over filled with ballast.

In accordance with the foregoing description of the apparatus, it will be appreciated that an improved method of ballast metering may be accomplished wherein old ballast may be removed from the track bed beneath the rails while the track and the rails are supported by a rail lifter, a portion of the removed ballast is cleaned and recovered, being returned to a metering hopper which rolls on the rails and disperses a quantity of the returned ballast or new ballast as needed beneath the rails in a pair of windrows, while maintaining a sufficient quantity of ballast in the hopper to assure adequate windrow formation. The windrows are graded by a sub-track grader associated with the hopper to provide a level track laying surface at a predetermined height. Ballast is introduced from the rear of the hopper between the graded windrows and outwardly of the rails and the track is released onto the metered ballast bed such that it returns to its original height. It should be noted that my apparatus also provides for metering ballast in a curve wherein one rail is higher than the other due to a "banking" of the ballast. To accomplish this, one of a pair of lateral deflectors 71 or 72 are extended to deflect ballast from chute 70 to the high side of the track where it accumulates. The screed profile of the skirts 56 and 57 and the rear wall 32 screed the ballast at the desired bank.

It may thus be seen that my apparatus and method will greatly facilitate the accurate relaying of an undercut track and preventing the unwanted accumulation of ballast on the track.

While I have shown my invention in one form, it will be obvious to those skilled in the art that it is not so limited but is susceptible of various changes and modifications without departing from the spirit thereof.

What I claim is:

1. A self metering ballast replacement apparatus for automatically distributing ballast beneath a railroad track including a pair of parallel rails affixed to a plurality of transverse crossties comprising in combination:

(a) a hopper for selectively receiving ballast from a screening devise and from a supply of new ballast; said hopper having a forward discharge and a center discharge opening;

(b) means for supporting said hopper on said rails for movement therealong;

(c) means for selectively directing ballast within said hopper to said forward or to said center discharge opening so that a predetermined gravitational mass of ballast is maintained within said hopper;

(d) a proximity sensor operatively connected within said hopper for continuously sensing the amount of ballast within said hopper and for actuating said means for directing; and (e) means for screeding ballast discharged from said hopper beneath said ties.

2. Apparatus defined in claim 1 wherein said hopper include deflector means associated with said forward discharge opening for directing ballast laterally beneath said rails responsive to the gravitational head of the ballast within said hopper.

3. Apparatus as defined in claim 1 further comprising means for screeding ballast discharged from said hopper from atop said crossties.

4. Apparatus as defined in claim 1 wherein said means for directing comprises a conveyor mounted within said hopper for moving ballast longitudinally therewithin; and means for driving said conveyor in a forward or rearward direction.

5. Apparatus for metering ballast beneath a railroad track including a pair of parallel rails affixed to a plurality of transverse crossties comprising in combination:

(a) a hopper for selectively receiving ballast from a screening device and from a supply of new ballast; said hopper having a forward discharge and a center discharge opening;

(b) means for supporting said hopper on said rails for movement therealong;

(c) means for selectively directing ballast within said hopper to said forward or to said center discharge openings comprising a conveyor mounted within said hopper for moving ballast longitudinally therewithin and means for driving said conveyor in a forward or rearward direction;

(d) means for continuously sensing the amount of ballast in said hopper comprising a proximity sensor mounted a predetermined height in said hopper above said forward discharge opening for sensing the presence of ballast at said height operatively connected to actuate said conveyor to deliver new ballast to said forward discharge opening when said presence of ballast is not sensed; and (e) means for screeding ballast discharged from said hopper beneath said ties.

6. Apparatus as defined in claim 1 wherein said forward discharge opening directs ballast laterally beneath said rails and said rear center discharge opening directs ballast downwardly between said rails.

7. Apparatus as defined in claim 1 wherein said means for screeding comprises a plow extending transversely of said track and carried beneath said crossties intermediate said forward and center discharge openings such that ballast deposited by said forward discharge opening is leveled to a preselected height.

8. Apparatus as defined in claim 1 further comprising chute means mounted above said center discharge opening for directing ballast outwardly of said rails to form a bed of ballast beneath said track.

9. Apparatus as defined in claim 8 wherein said chute means comprises a pair of opposed downwardly and outwardly inclined chutes extending from a pair of opposed side openings in said hopper, said side openings defined in said hopper at a preselected height above said track, said chutes including a deflector plate extending within said hopper beneath said side openings.

10. Apparatus for metering ballast beneath a railroad track including a pair of parallel rails affixed to a plurality of transverse crossties comprising in combination:

(a) a hopper for selectively receiving ballast from a screening device and from a supply of new ballast; said hopper having a forward discharge and a center discharge opening;

(b) a chute means mounted above said center discharge opening for directing ballast outwardly of said rails to form a bed of ballast beneath said track;

(c) means for supporting said hopper on said rails for movement therealong;

(d) means for selectively directing ballast within said hopper to said forward or to said center discharge openings;

(e) means for continuously sensing the amount of ballast in said hopper comprising a proximity sensor mounted at a height above said forward discharge opening for sensing the height of said ballast in said hopper and operatively connected to actuate said conveyor to deliver ballast to center discharge opening; and (f) means for screeding ballast discharged from said hopper beneath said ties.

11. Apparatus as defined in claim 8 wherein said forward discharge opening, said center discharge opening and said chute means terminate proximal the height of the top of said crossties and for preventing lateral dispersal of ballast above the height of termination thereof.

12. Apparatus for metering ballast beneath a railroad track including a pair of parallel rails affixed to a plurality of transverse crossties comprising in combination:

(a) a hopper for selectively receiving ballast from a screening device and from a supply of new ballast; said hopper having a forward discharge opening, a center discharge opening and a chute means mounted above said center discharge opening for directing ballast outwardly of said rails to form a bed of ballast beneath said track; said forward discharge opening, said center discharge opening and said chute means terminating proximal the height of the top of said crossties for preventing lateral dispersal of ballast above the height of termination thereof;

(b) means for supporting said hopper on said rails for movement therealong;

(c) means for selectively directing ballast within said hopper to said forward or to said center discharge openings;

(d) means for continuously sensing the amount of ballast in said hopper comprising a proximity sensor mounted at a selected height to sense the accumulation of ballast within said hopper at said height and to stop the flow of said ballast from a screening device and a supply responsive thereto; and (f) means for screeding ballast discharged from said hopper beneath said ties.

13. A self metering ballast replacement apparatus for automatically distributing ballast beneath a railroad track held in suspension by means engaging the rails of said track and supporting the crosstie thereof comprising:

(a) means supportable on said rails for selectively distributing said ballast laterally and centrally relative said track and for confining said ballast not so distributed;

(b) a proximity sensor for continuously sensing the amount of ballast within said distributing means; and (c) means for grading said distributed ballast to a preselected height.

14. A self metering ballast replacement apparatus for automatically distributing ballast beneath a railroad track held in suspension by means engaging the rails of said track and supporting the crosstie thereof comprising:

(a) means supportably on said rails for selectively distributing said ballast laterally and centrally relative said track and for confining said ballast not so distributed; said distributing means comprising a hopper supported on a plurality of rail engaging rollers and displaceable vertically to a non-rail engaging position, said hopper having forward discharge openings and a center discharge opening;

(b) a proximity sensor for continuously sensing the amount of ballast within said distributing means; and (c) means for grading said distributed ballast to a preselected height.

15. Apparatus as defined in claim 14 wherein said means for distributing further comprises: a conveyor means for moving ballast forwardly or rearwardly to said openings responsive to said sensor means.

16. Apparatus as defined in claim 15 wherein said distributing means further comprises deflector means associated with said forward openings for deflecting ballast discharge from said hopper laterally beneath said rails.

17. Apparatus as defined in claim 14 further comprising chute means mounted above said center discharge opening for directing ballast outwardly of said rails to form a bed of ballast beneath said track.

18. Apparatus as defined in claim 17 wherein said means for screeding comprises a plow extending transversely of said track and carried beneath said crossties intermediate said forward and rear openings such that ballast deposited by said forward opening is leveled to a preselected height.

19. Apparatus as defined in claim 17 wherein said forward discharge opening said center discharge opening and said chute means terminate proximal the height of the top of said crossties and prevent lateral dispersal of ballast above the height of termination thereof.

20. Apparatus as defined in claim 18 further comprising means for selectively deflecting ballast to one of said opposed chutes.

21. A method for metering ballast replaced beneath the crossties and track of a railroad wherein the ballast beneath said crossties and track has been removed by an undercutter comprising the steps of:

(a) supporting said rails and crossties with a rail lifting apparatus;

(b) returning reconditioned ballast to a ballast hopper for confinement and discharge to beneath said rails wherein a predetermined minimum volume of ballast is maintained within said hopper;

(c) sensing the level of ballast aboove said forward opening with a proximity sensor and moving fresh ballast deposited into said hopper forwardly to maintain said ballast at a predetermined level responsive to said sensed level of said ballast, (d) discharging said ballast in a downward and outward direction from said forward opening of said hopper to form windrows of ballast substantially adjacent and beneath said rails;

(e) grading said windrows to a predetermined height to support said crossties and rails; and (f) introducing ballast from said hopper to beneath said crossties and rails to reconstitute the track bed.

* * * * *